US012116893B2

(12) United States Patent
Zhang et al.

(10) Patent No.: US 12,116,893 B2
(45) Date of Patent: Oct. 15, 2024

(54) SHEAR PIN FOR DEACTIVATING A STEERING PAD OF A ROTARY STEERABLE SYSTEM

(71) Applicant: Halliburton Energy Services, Inc., Houston, TX (US)

(72) Inventors: Lizheng Zhang, Humble, TX (US); Paravastu Badrinarayanan, Cypress, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 8 days.

(21) Appl. No.: 17/816,893

(22) Filed: Aug. 2, 2022

(65) Prior Publication Data

US 2024/0044208 A1 Feb. 8, 2024

(51) Int. Cl.
*E21B 7/06* (2006.01)
*E21B 34/06* (2006.01)

(52) U.S. Cl.
CPC ..... *E21B 7/06* (2013.01); *E21B 34/06* (2013.01)

(58) Field of Classification Search
CPC ..... E21B 7/06; E21B 34/06
See application file for complete search history.

(56) References Cited

U.S. PATENT DOCUMENTS 5,706,905 A 1/1998 Barr
5,803,185 A 9/1998 Barr et al.
6,089,332 A 7/2000 Barr et al.
6,116,354 A * 9/2000 Buytaert ..... E21B 17/1014 175/45
9,016,400 B2 4/2015 Clausen et al.
9,121,223 B2 9/2015 Niina et al.
11,421,481 B2 8/2022 Chambers et al.
11,566,481 B2 1/2023 Chambers et al.
2001/0040054 A1* 11/2001 Haugen ..... E21B 29/06 166/207
2004/0134687 A1* 7/2004 Radford ..... E21B 47/18 175/57
2010/0071962 A1 3/2010 Beuershausen
(Continued)

FOREIGN PATENT DOCUMENTS

WO 2019133033 A1 7/2019

OTHER PUBLICATIONS

International Patent Application No. PCT/US2022/074429, International Search Report and Written Opinion mailed Apr. 25, 2023, 9 pages.

(Continued)

*Primary Examiner* — George S Gray
(74) *Attorney, Agent, or Firm* — NOVAK DRUCE CARROLL LLP

(57) ABSTRACT

A body of a shear pin can be positioned in a pad stopper of a steering pad of a rotary steerable system. The rotary steerable system can be used to steer a drill in a wellbore. The steering pad can be positioned on the rotary steerable system such that a head of the shear pin is coupled with a lateral pad of the rotary steerable system. The head of the shear pin can deactivate the steering pad by preventing the steering pad from actuating. A fluid pulse can be output in the wellbore to break the shear pin for enabling the steering pad to actuate to cause the rotary steerable system to steer the drill in the wellbore.

20 Claims, 6 Drawing Sheets

(56) References Cited

U.S. PATENT DOCUMENTS

| | | | | |
|---|---|---|---|---|
| 2012/0160563 | A1 | 6/2012 | Clark et al. | |
| 2012/0160564 | A1 | 6/2012 | Downton et al. | |
| 2012/0160565 | A1 | 6/2012 | Downton et al. | |
| 2014/0000966 | A1* | 1/2014 | Fuhst | C10M 169/06 184/14 |
| 2016/0084007 | A1 | 3/2016 | Sugiura | |
| 2017/0058617 | A1 | 3/2017 | Bartel | |
| 2017/0204671 | A1 | 7/2017 | Laing et al. | |
| 2020/0003010 | A1 | 1/2020 | Bittleston et al. | |
| 2020/0056451 | A1 | 2/2020 | Chambers et al. | |
| 2020/0080381 | A1* | 3/2020 | Hardin, Jr. | E21B 7/06 |
| 2020/0199970 | A1 | 6/2020 | Odegbami | |
| 2020/0325731 | A1 | 10/2020 | Chambers et al. | |
| 2020/0332597 | A1* | 10/2020 | Doud | E21B 7/067 |
| 2020/0332599 | A1* | 10/2020 | Doud | E21B 7/06 |
| 2021/0164292 | A1* | 6/2021 | Deolalikar | E21B 7/062 |
| 2021/0324682 | A1 | 10/2021 | Chambers et al. | |

OTHER PUBLICATIONS

International Patent Application No. PCT/US2022/074430, International Search Report and Written Opinion mailed Apr. 27, 2023, 12 pages.

* cited by examiner

SHEAR PIN FOR DEACTIVATING A STEERING PAD OF A ROTARY STEERABLE SYSTEM

TECHNICAL FIELD

The present disclosure relates generally to wellbore operations and, more particularly (although not necessarily exclusively), to a shear pin for deactivating a steering pad of a rotary steerable drilling system that can be used to form a wellbore.

BACKGROUND

A wellbore can be formed in a subterranean formation for extracting produced hydrocarbon material or other suitable material. The wellbore may experience or otherwise encounter one or more wellbore operations such as drilling the wellbore. Drilling, or otherwise forming, the wellbore can involve using a drilling system that can include a drill bit and other suitable tools or components for forming the wellbore. During drilling, the drilling system can use a steering pad to change the course of the drill bit by applying pressure to a wall of the wellbore. Deactivating the steering pad can be difficult.

DETAILED DESCRIPTION

Figure 1:
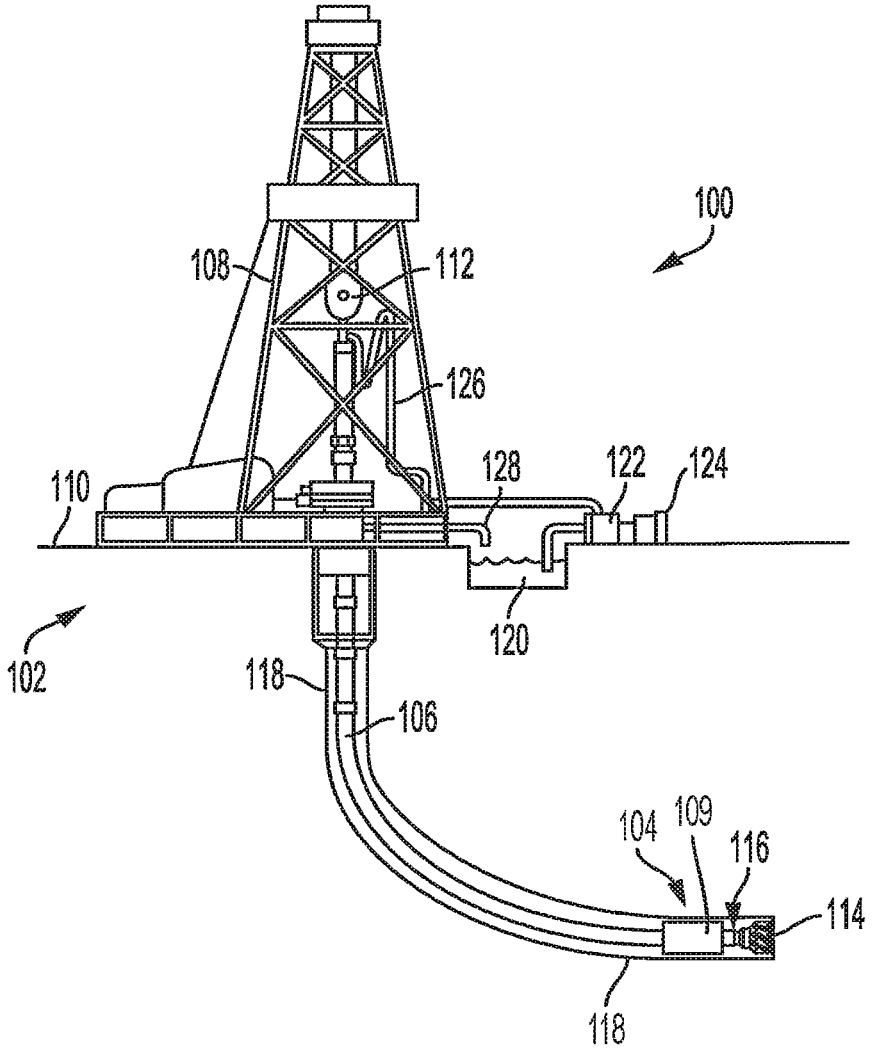
FIG. 1 is a schematic of a well system that includes a rotary steerable system with one or more steering pads for forming a wellbore according to one example of the present disclosure.

Certain aspects and features of the present disclosure relate to a shear pin that can be included in a steering pad to deactivate the steering pad of a rotary steerable system. In some examples, the rotary steerable system can be used to drill or otherwise form a wellbore. The shear pin can be inserted in a pad stopper, which may be affixed to a lateral side of the steering pad. The steering pad can be positioned on the rotary steerable system facing a wall of the wellbore. The rotary steerable system can include a lateral pad adjacent to the steering pad and to the pad stopper. The lateral pad can include a t-slot that can be sized to receive a head of the shear pin. The shear pin can prevent the steering pad from actuating. For example, the shear pin can hold the steering pad in place with respect to the lateral pad for sufficiently low pressures of fluid flow in the wellbore. In some examples, the shear pin can keep the steering pad fully closed during an initial run of the rotary steerable system into the wellbore or in other suitable circumstances. The shear pin can be broken or sheared with a fluid pulse. For example, the shear pin can be broken with a pulse of pressurized mud or drilling fluid. The fluid pulse can be outputted at a particular pressure for breaking the shear pin. In some examples, the fluid pulse can be outputted at a particular depth associated with a multilateral window of the wellbore or a particular time associated with a multilateral window of the wellbore.

Allowing the steering pads to actuate prematurely can result in excessive wear on components included in the rotary steerable systems. For example, a steering pad can experience excessive wear, the wellbore can be damaged, and the like. In some examples, steering pads can be mechanically coupled to the rotary steerable systems via a joint that allows the steering pads to rotate with respect to the rotary steerable systems. If the steering pads actuate prematurely, the joint may be subject to unnecessary torque that may not contribute to any steering or adjustment of trajectory associated with the rotary steerable system. The unnecessary torque can degrade the hinge and compromise the structural integrity of some parts of the rotary steerable system. Furthermore, allowing the steering pads to actuate prematurely can result in undesired friction, which can result in excessive wear, between a casing sleeve of a wellbore and the steering pads. Excessive wear on the steering pad can compromise the ability of the steering pad to steer the rotary steerable system.

Including a shear pin to prevent the steering pad from actuating can allow the steering pad of the rotary steerable system to be deactivated and can prevent or mitigate excessive wear on components of the rotary steerable system, damage to the wellbore, or a combination thereof. For example, using the shear pin to deactivate the steering pad can reduce or eliminate excessive friction in the rotary steerable system, for example between the steering pad and the casing sleeve, which can improve the integrity of the steering pad, the wellbore casing, and other suitable components of the rotary steerable system. Furthermore, deactivating the steering pad with the shear pin can prevent wear at an interface between the steering pad and lateral pad during a trip-in and in other suitable circumstances.

A shear pin can be included in the rotary steerable system for deactivating one or more steering pads. The shear pin can include a head, a body, and any other suitable components. The body of the shear pin can be threaded into or pressed (e.g., press-fit) into the steering pad. For example, the steering pad can include a pad stopper that can include threads or an interference fit portion to receive the body of the shear pin. The head of the shear pin can be positioned in a suitable corresponding component (e.g., a t-slot) of a lateral pad of the rotary steerable system. Accordingly, the shear pin may prevent the steering pad from actuating outward or otherwise with respect to the lateral pad.

In some examples, the steering pad can be kept at a closed position once the lateral pads are installed and bolted down. By keeping the steering pad closed, the rotary steerable system can pass through a milled casing exit window, such as a sidetrack, in a multilateral junction without interfering with a casing window of the wellbore or other suitable portions of the wellbore. For example, keeping the steering pad closed can prevent the steering pads from exerting a force on the casing while the rotary steerable system passes through the casing window. Once steering pads have passed the exit window, the fluid pulse can be sent from surface to shear the pin to enable the steering pads to be actuated. The shear pin can be broken into a first piece, a second piece, and any other suitable pieces. In some examples, the first piece can be contained in the pad stopper, and the second piece can be contained in the lateral pad, etc. Additionally or alternatively, the first piece, the second piece, and any other suitable pieces of the broken shear pin can be prevented from exiting the rotary steerable system while the rotary steerable system is positioned in the wellbore.

The rotary steerable system can include or otherwise be coupled to a drilling tool, such as a drill bit, for forming a wellbore. The rotary steerable system can include an actuation cylinder that can actuate or otherwise open in response to receiving pressurized mud. By actuating, the actuation cylinder can use pistons to actuate or otherwise engage a steering pad that, when engaged, exerts force on the borehole to change the direction of drilling of the drilling tool. In some examples, the drilling tool can include a radial seal and can be positioned between a steering collar and an actuation cylinder. The drilling tool may include a pad actuator or other suitable tool for drilling into a subterranean formation to form a wellbore for extracting produced hydrocarbons. In some examples, the tool can drill directionally with continuous rotation from the surface of the subterranean formation. The steering collar can be a frame of the drilling tool and may stiffen the drilling tool to allow the drilling tool to exert force on a borehole for changing a direction of drilling while forming the wellbore.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 that can use a rotary steerable system 109 to form a wellbore 118 according to one example of the present disclosure. The well system 100 can include the wellbore 118 that can be used to extract hydrocarbons from a subterranean formation 102. The wellbore 118 can be drilled or otherwise formed using the well system 100. For example, the well system 100 may drive a bottom hole assembly (BHA) 104 positioned or otherwise arranged at the bottom of a drill-string 106 extended into the subterranean formation 102 from a derrick 108 arranged at the surface 110. The derrick 108 can include a kelly 112 used to lower and raise the drill-string 106.

The BHA 104 may include a drill bit 114, a rotary steerable system 109, other suitable components, or any suitable combination thereof. The drill bit 114 can be operatively coupled to a tool string 116, and the drill bit 114 may be moved axially within a drilled wellbore 118 and can be attached to the drill-string 106. During operation, the drill bit 114 can penetrate the subterranean formation 102 to create the wellbore 118. The BHA 104 can control the drill bit 114 as the drill bit 114 advances into the subterranean formation 102. For example, the rotary steerable system 109 can control a direction of drilling by applying a steering pressure or other suitable force to a wall of the wellbore 118.

Fluid or "mud" from a mud tank 120 may be pumped downhole using a mud pump 122 that can be powered by an adjacent power source, such as a prime mover or motor 124. The mud may be pumped from the mud tank 120, through a stand pipe 126, which can feed the mud into the drill-string 106, the rotary steerable system 109, or other suitable components of the well system 100 and can convey the mud to the drill bit 114. The mud can exit one or more nozzles (not shown) arranged in the drill bit 114 and can thereby cool the drill bit 114. Additionally or alternatively, the mud can be directed (e.g., as pressurized mud) into the rotary steerable system 109 for adjusting a direction of the drill bit 114. After exiting the drill bit 114 or other suitable component, the mud can circulate back to the surface 110 via the annulus defined between the wellbore 118 and the drill-string 106. Cuttings and mud mixture that can be passed through a flow line 128 can be processed such that a cleaned mud is returned down hole through the stand pipe 126.

The rotary steerable system 109 can include a steering collar, an actuation cylinder, a radial seal, a steering pad, a lateral pad, a shear pin, other suitable components, or any suitable combination thereof. The steering collar can provide a rigid frame for the rotary steerable system 109, and the actuation cylinder can include a piston that can be used to apply the steering pressure or other suitable forces. The radial seal can be positioned between the steering collar and the actuation cylinder for forming a pressure seal or other suitable type of seal in the rotary steerable system 109. For example, the radial seal can allow the rotary steerable system 109 to receive pressure (e.g., via pressurized mud, etc.) that can be used to apply the steering force. The rotary steerable system 109 can include a steering pad. The steering pad can exert (e.g., via force from the piston) a force on a wall of the wellbore 118 for adjusting a direction of the drill bit 114. The steering pad can be coupled to the rotary steerable system 109 via a lateral pad or via any other suitable component of the rotary steerable system 109. The steering pad can include a pad stopper that can be sized to receive a shear pin. At least a portion of the shear pin can be positioned in the pad stopper to prevent the steering pad from actuating by preventing the steering pad from moving with respect to the lateral pad.

Figure 2:
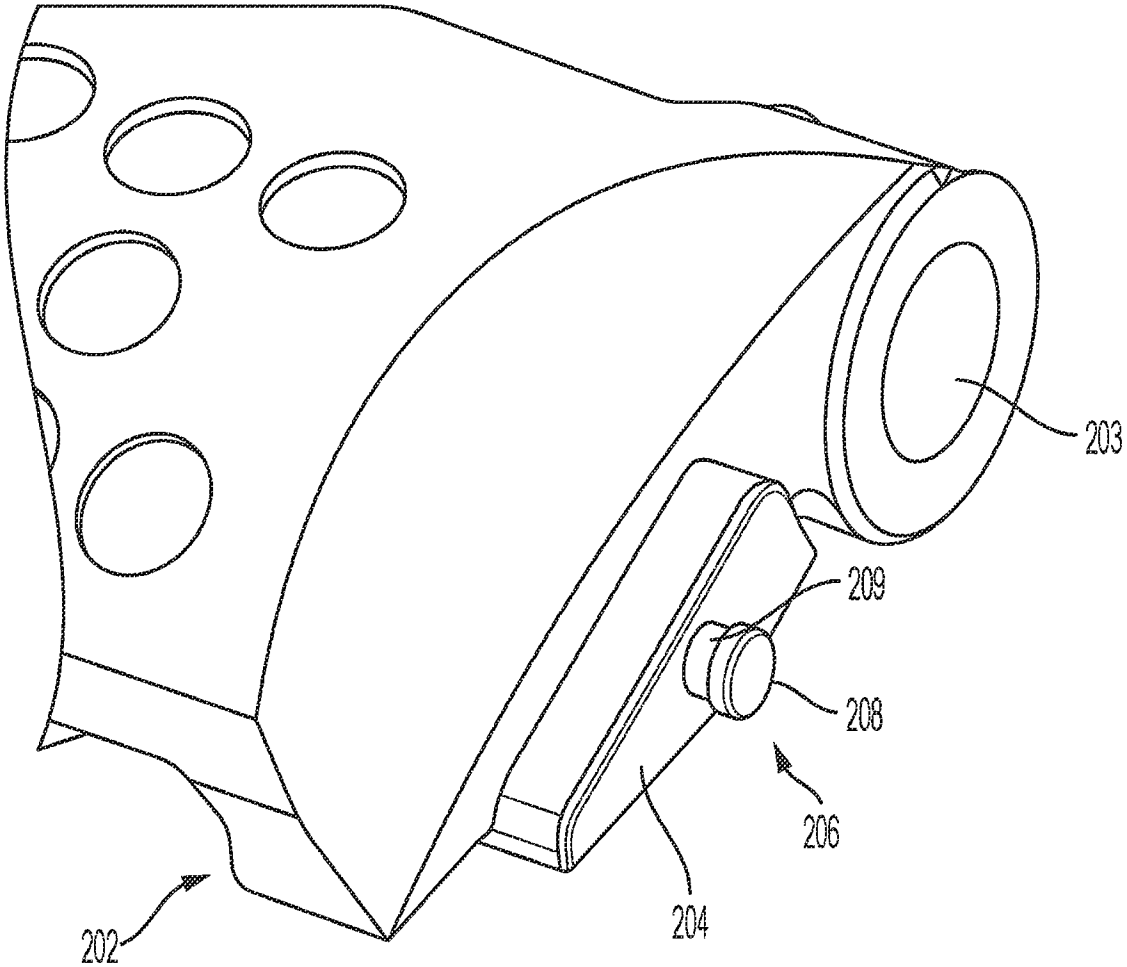
FIG. 2 is a perspective view of a steering pad that includes a shear pin for deactivating the steering pad according to one example of the present disclosure.

FIG. 2 is a perspective view of a steering pad 202 that includes a shear pin 206 for deactivating the steering pad 202 according to one example of the present disclosure. The steering pad 202 can be coupled to the rotary steerable system 109 by a hinge 203. The steering pad 202 can rotate via the hinge 203 and with respect to the rotary steerable system 109. Actuating the steering pad 202 can cause the steering pad 202 to displace outward from the rotary steerable system 109 to exert a force on a wall of a wellbore 118. Exerting a force on the wall of the wellbore 118 via the steering pad 202 can enable a trajectory or drilling direction of the rotary steerable system 109 to be adjusted.

The steering pad 202 can include a pad stopper 204. In some examples, the pad stopper 204 can be a raised surface. For example, the pad stopper can be a raised surface positioned on a lateral side of the steering pad 202. The pad stopper 204 can be sized to receive the shear pin 206. For example, the pad stopper 204 can include a female interference fit portion for receiving a male interference fit portion of a body 209 of the shear pin 206. In some examples, the steering pad 202 can include a second pad stopper positioned opposite from the pad stopper 204 with respect to the steering pad 202. In such examples, the second pad stopper can be sized to receive a second shear pin, which may be similar or identical to the shear pin 206, though, in some examples, the second shear pin can be different than the shear pin 206.

The shear pin 206 can include a head 208 and the body 209. In some examples, the head 208 of the shear pin 206, the body 209 of the shear pin 206, or a combination thereof can be cylindrically shaped. Other suitable shapes for the head 208 of the shear pin 206, the body 209 of the shear pin 206, or a combination thereof are possible. As illustrated, the head 208 of the shear pin 206 can include a larger diameter than the body 209 of the shear pin 206, though the diameter of the head 208 can alternatively be less than or equal to the diameter of the body 209. In some examples, the head 208 of the shear pin 206 can be shorter than the body 209 of the shear pin 206. The body 209 of the shear pin 206 can include a notch for separating an outward-facing portion and an inward-facing portion of the shear pin 206. For example, the notch can be positioned on the body 209 of the shear pin 206 and may include notching, scoring, or other suitable forms of intentional deformation to cause the shear pin 206 to controllably break.

Figure 3:
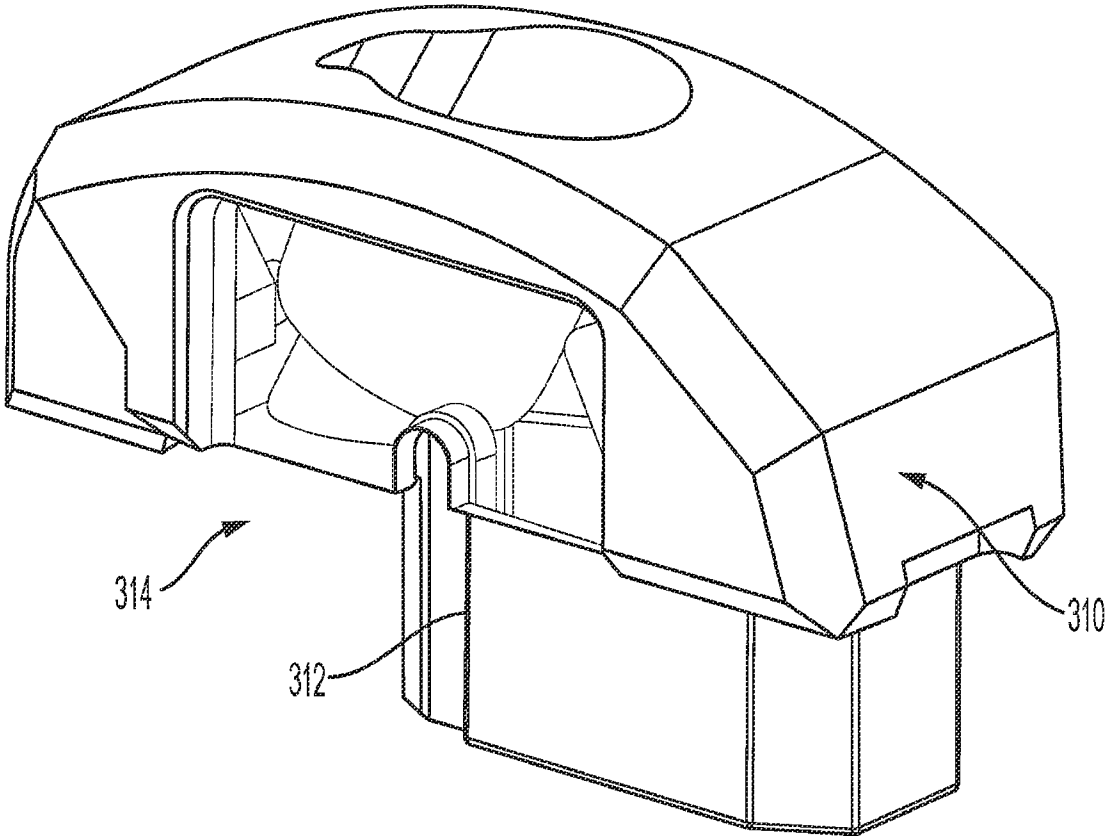
FIG. 3 is a perspective view of a lateral pad that can receive a shear pin for deactivating the steering pad according to one example of the present disclosure.

FIG. 3 is a perspective view of a lateral pad 310 that can receive a shear pin 206 for deactivating the steering pad 202 according to one example of the present disclosure. The lateral pad 310 can be affixed to a rotary steerable system 109. For example, the lateral pad 310 can be bolted down to an exterior of the rotary steerable system 109. In some examples, the lateral pad 310 can be affixed to the rotary steerable system 109 such that the lateral pad 310 is abutting or otherwise adjacent to the steering pad 202. The lateral pad 310 can otherwise suitably be affixed to the rotary steerable system 109.

The lateral pad 310 can include a t-slot 312. The t-slot 312 can be positioned in a receiving portion 314 of the lateral pad 310. The receiving portion 314 can be sized to receive the pad stopper 204 of the steering pad 202 or any other suitable component of the steering pad 202. In some examples, the steering pad 202, in response to breaking the shear pin 206, may be allowed to actuate outward based on the receiving portion 314 of the lateral pad 310. The t-slot 312 can be sized to receive at least a portion of the shear pin 206. For example, the head 208 of the shear pin 206 can be inserted (e.g., by positioning the steering pad 202 abutting the lateral pad 310) into the t-slot 312 to prevent undesired motion of the steering pad 202 with respect to the lateral pad 310.

Once inserted, the shear pin 206 can prevent the steering pad 202 from actuating. For example, the shear pin 206 can prevent the steering pad 202 from actuating under sufficiently low mud pressures such as mud pressures lower than a threshold for breaking the shear pin 206. The shear pin 206 can break in response to receiving a fluid pulse having a mud pressure exceeding the threshold or in response to receiving a flow rate above a threshold flow rate for breaking the shear pin, etc. The fluid pulse can be generated by a mud pump that can be positioned at or above the surface of, or in other suitable locations with respect to, the wellbore. Once broken, a first broken piece of the shear pin 206 can be contained in a hollow portion of the pad stopper 204, and a second broken piece of the shear pin 206 can be contained in a hollow portion of the lateral pad 310 to prevent debris from the shear pin 206 from being released into the wellbore. In some examples, the shear pin 206 may break into additional pieces that each may be contained in either the hollow portion of the pad stopper 204 or the hollow portion of the lateral pad 310. Subsequent to the shear pin 206 breaking, pressurized mud travelling through the rotary steerable system 109 can cause the steering pad 202 to actuate.

Figure 4:
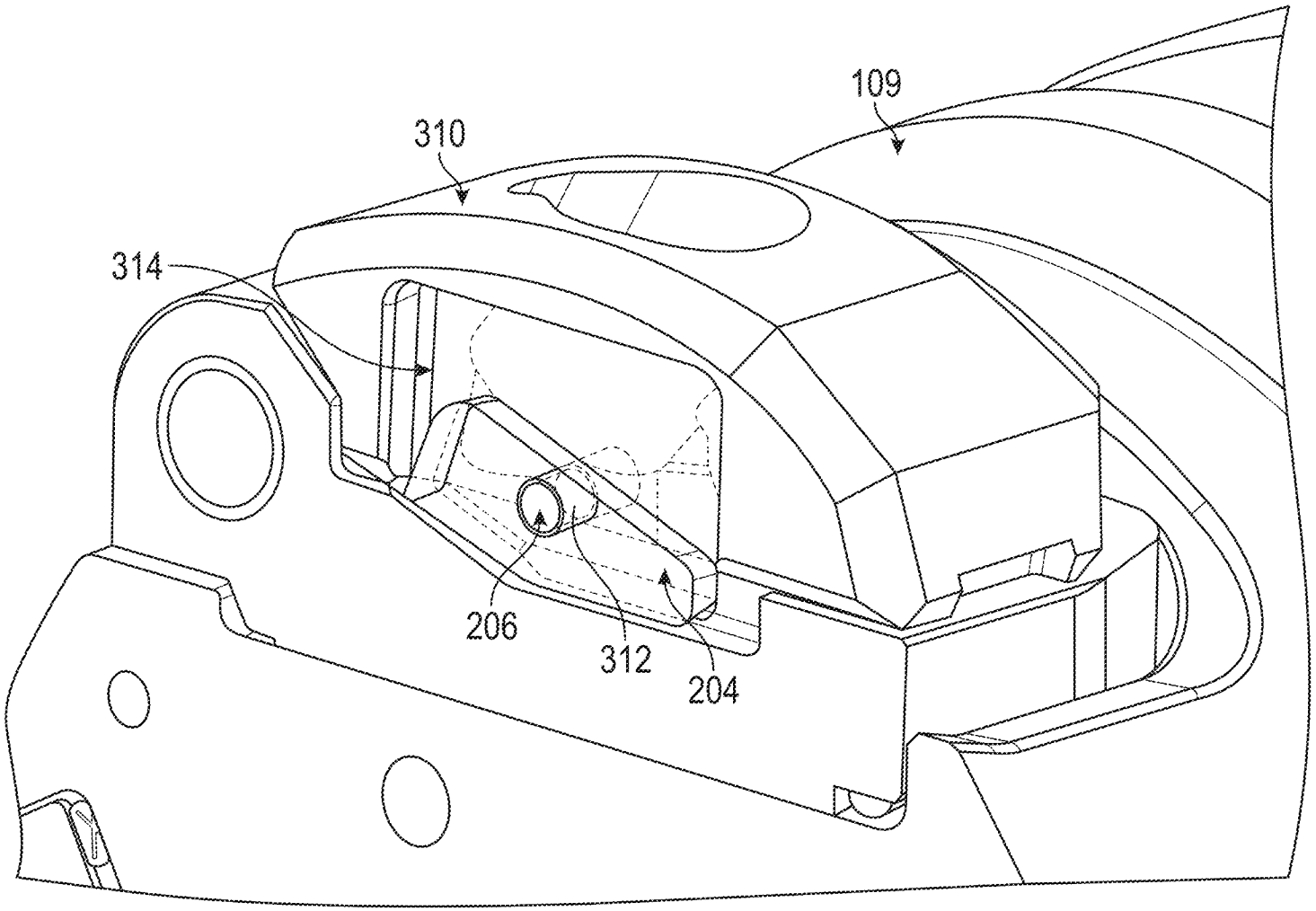
FIG. 4 is a perspective view of a rotary steerable system that includes a lateral pad that can receive a shear pin for deactivating the steering pad according to one example of the present disclosure.

FIG. 4 is a perspective view of a rotary steerable system 109 that includes a lateral pad 310 that can receive a shear pin 206 for deactivating the steering pad 202 according to one example of the present disclosure. As illustrated, the pad stopper 204 can be positioned adjacent to the receiving portion 314 of the lateral pad 310. The shear pin 206 can be positioned in the t-slot 312 of the lateral pad 310, and the shear pin 206, prior to breaking, can prevent the pad stopper 204, and by extension the steering pad 202, from actuating with respect to the lateral pad 310. The lateral pad 310 can be positioned on an exterior of the rotary steerable system 109. The receiving portion 314 can define a range-of-motion of the pad stopper 204, and by extension the steering pad 202, with respect to the lateral pad 310. For example, subsequent to the shear pin 206 breaking, the pad stopper 204 may be free to actuate throughout the receiving portion 314.

Figure 5:
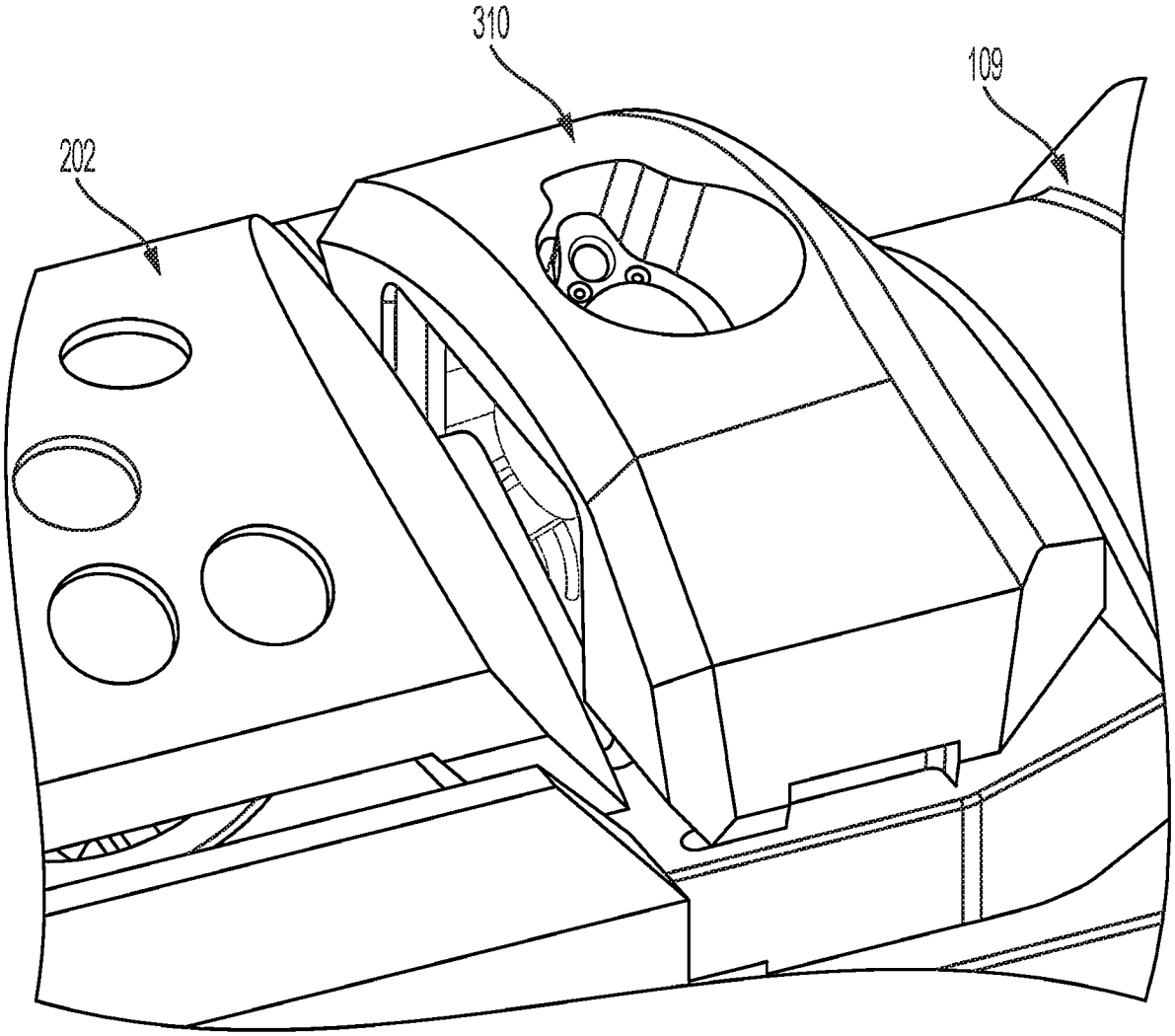
FIG. 5 is a perspective view of a rotary steerable system that includes a steering pad with a shear pin for deactivating the steering pad according to one example of the present disclosure.

FIG. 5 is a perspective view of a rotary steerable system 109 that includes a steering pad 202 that includes a shear pin 206 for deactivating the steering pad 202 according to one example of the present disclosure. As illustrated, the steering pad 202 is positioned adjacent to and abutting the lateral pad 310. The lateral pad 310 can be fastened to the rotary steerable system 109 by one or more bolts, one or more screws, any other suitable fasteners or fastening techniques, or any suitable combination thereof. As illustrated, the steering pad 202 is in a deactivated position. In some examples, the shear pin 206 can be positioned in the t-slot 312 of the lateral pad 310 to retain the steering pad 202 in the deactivated position. The steering pad 202 can be mechanically engaged (including mechanically affixed) with the lateral pad 310 via the pad stopper 204, the shear pin 206, other suitable components, or any suitable combination thereof.

While the steering pad 202 is in the deactivated position, and subsequent to positioning the shear pin 206 in the t-slot 312, the shear pin 206 may prevent the steering pad 202 from actuating. By preventing the steering pad 202 from actuating, the shear pin 206 may prevent undesired contact between the steering pad 202 and a casing or wall of the wellbore 118. The steering pad 202 can be enabled to actuate by breaking the shear pin 206. For example, the shear pin 206 can break in response to a fluid pulse. The fluid pulse can be output when the rotary steerable system 109 exceeds a time value, depth value, or the like associated with a multilateral window of the wellbore. For example, the fluid pulse can be output subsequent to elapsing the travel time or depth for the rotary steerable system 109 to exit the multilateral window of the wellbore 118.

The multilateral window of the wellbore 118 can be a region of the wellbore 118 in which the wellbore 118 diverges into one or more side-tracks such as lateral wellbores off the wellbore 118. Preventing the steering pad 202 from actuating while the rotary steerable system 109 travels through the multilateral window of the wellbore 118 can prevent an actuated steering pad 202 from getting caught in a junction between the wellbore and one of the side-tracks. The fluid pulse can be output at a pre-specified pressure or flow rate for breaking the shear pin 206.

Figure 6:
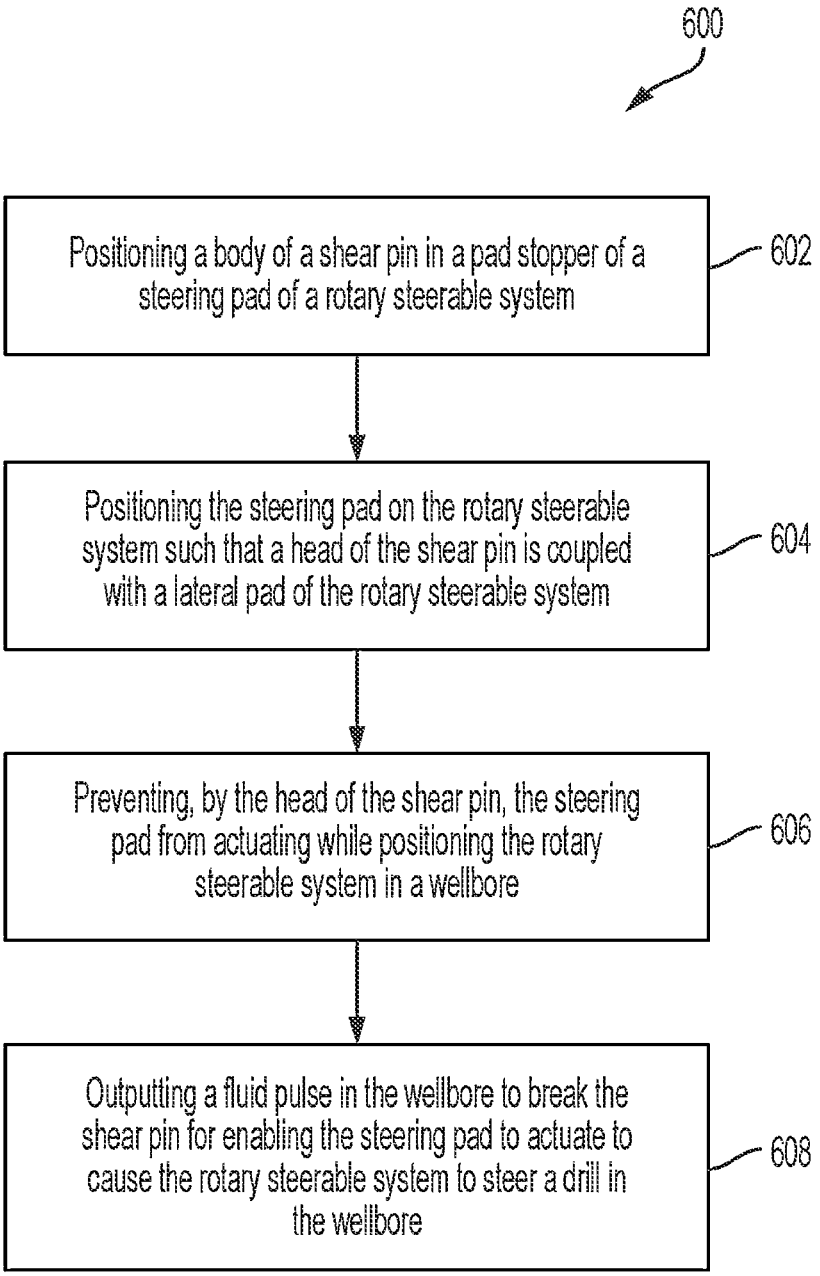
FIG. 6 is a flowchart of a process for using a shear pin to deactivate a steering pad according to one example of the present disclosure.

FIG. 6 is a flowchart of a process 600 for using a shear pin 206 to deactivate a steering pad 202 according to one example of the present disclosure. At block 602, a body 209 of a shear pin 206 is positioned in a pad stopper 204 of a steering pad 202 of a rotary steerable system 109. Positioning the body 209 of the shear pin 206 in the pad stopper 204 of the steering pad 202 can involve pressing the shear pin 206 into the pad stopper 204. For example, the shear pin 206 can include a male interference fit portion and the pad stopper 204 can include a female interference fit portion. The male and female interference fit portions can be pressed together such that the male interference fit portion is mechanically engaged (e.g., via frictional forces, etc.) with the female interference fit portion. Alternatively, the pad stopper 204 can include a threaded portion that is sized to receive a threaded portion of the body 209 of the shear pin 206. The pad stopper 204 can be positioned on a lateral side of the steering pad 202 for receiving the shear pin 206. For example, a longitudinal axis of the shear pin 206 may be parallel to a wall of the wellbore 118.

In some examples, the rotary steerable system can include more than one steering pad 202, more than one lateral pads 310, more than one shear pin 206, or any suitable combination thereof. For example, the rotary steerable system 109 can include a second steering pad. The second steering pad can include a second pad stopper. The second steering pad can be mechanically coupled to a second lateral pad. The second pad stopper of the second steering pad can receive a second shear pin, for example via a second body of the second shear pin). The second shear pin can include a second head and the second body. The second lateral pad can include a second t-slot that can receive the second head of the second shear pin. The second shear pin can prevent the second steering pad from actuating. In some examples, one or more steering pads of the rotary steerable system 109 can include more than one pad stopper (e.g., positioned opposite one another with respect to the steering pad) for receiving more than one shear pin for deactivating the steering pad.

At block 604 the steering pad 202 is positioned on the rotary steerable system 109 such that a head 208 of the shear pin 206 is positioned in a t-slot 312 of a lateral pad 310 positioned on the rotary steerable system 109. The steering pad 202 may be further positioned on the rotary steerable system 109 via a hinge 203 that can be attached to the rotary steerable system 109 for enabling the steering pad 202 to rotate with respect to the rotary steerable system 109.

At block 606 the head 208 of the shear pin 206 prevents the steering pad 202 from actuating while positioning the rotary steerable system 109 in a wellbore. Preventing the steering pad 202 from actuating can prevent the steering pad 202 from making undesired contact with a wall of the wellbore. The pad stopper 204 can be positioned on a lateral surface of the steering pad 202. The pad stopper 204 can be engaged with a lateral surface of the lateral pad 310 for coupling the steering pad 302 with the lateral pad 310. The lateral pad 310 can include a t-slot 312 that can be sized to receive the head of the shear pin 206. The shear pin 206 can prevent the steering pad 202 from actuating by holding the steering pad 202 in place with respect to the lateral pad 310.

At block 608, a fluid pulse is output in the wellbore 118 to break the shear pin 206 for enabling the steering pad 202 to actuate for steering the rotary steerable system 109 in the wellbore 118. The fluid pulse can be output by a mud pump positioned at the surface with respect to the wellbore 118. For example, the fluid pulse can be a pulse of mud or drilling fluid pumped into the wellbore 118. The fluid pulse can include a flow rate that can exceed a flow rate threshold for causing the shear pin 206 to break and can apply a differential pressure to the shear pin 206 that exceeds a differential pressure for causing the shear pin 206 to break. In response to receiving the fluid pulse, the shear pin 206 can break into two or more pieces. In some examples, the shear pin 206 can include a notch for separating an inward-facing portion of the shear pin 206 from an outward-facing portion of the shear pin 206. The notch can enable the shear pin 206 to break with respect to the notch.

Upon breaking, the outward-facing portion of the shear pin 206 can be contained in the pad stopper, and the inward-facing portion of the shear pin 206 can be contained in the lateral pad 310. Other suitable broken pieces of the shear pin 206 can be contained in the pad stopper 204, the lateral pad 310, or any other suitable component of the rotary steerable system 109. Containing the outward-facing portion of the shear pin 206 in the pad stopper and containing the inward-facing portion of the shear pin 206 in the lateral pad 310 can prevent the inward-facing portion of the shear pin 206 and the outward-facing portion of the shear pin 206 from being released into the wellbore. Containing the portions of the shear pin 206 can prevent damage to or interference with other equipment that may be deployed in the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

In some aspects, methods, systems, and steering pads for preventing actuation of a steering pad are provided according to one or more of the following examples:

Example 1 is method comprising: positioning a body of a shear pin in a pad stopper of a steering pad of a rotary steerable system that is usable to steer a drill in a wellbore; positioning the steering pad on the rotary steerable system such that a head of the shear pin is coupled with a lateral pad of the rotary steerable system; deactivating, by the head of the shear pin, the steering pad by preventing the steering pad from actuating; and outputting a fluid pulse in the wellbore to break the shear pin for enabling the steering pad to actuate to cause the rotary steerable system to steer the drill in the wellbore.

Example 2 is the method of example 1, further comprising, in response to breaking the body of the shear pin: containing an outward-facing portion of the shear pin in the pad stopper; and containing an inward-facing portion of the shear pin in the lateral pad.

Example 3 is the method of any of examples 1-2, wherein the shear pin includes a notch for separating the outward-facing portion and the inward-facing portion of the shear pin, and wherein the notch includes an intentional deformation of the shear pin for allowing the shear pin to break in response to receiving the fluid pulse.

Example 4 is the method of example 1, wherein the fluid pulse is output subsequent to the rotary steerable system exceeding a depth value or a time value associated with a multilateral window of the wellbore.

Example 5 is the method of example 1, wherein the fluid pulse is output at a pre-determined pressure for breaking the shear pin.

Example 6 is the method of example 1, further comprising: positioning a second shear pin in a second lateral pad for deactivating a second steering pad of the rotary steerable system; and in response to breaking the second shear pin, enabling the second steering pad of the rotary steerable system to actuate.

Example 7 is the method of example 1, wherein positioning the body of the shear pin in the pad stopper comprises: coupling a threaded end of the shear pin with a threaded portion of the steering pad; or coupling a male interference fit portion of the shear pin to a female interference fit portion of the steering pad.

Example 8 is a steering pad comprising: a pad stopper that is sized to receive a shear pin that is couplable with a lateral pad of a rotary steerable system usable for steering a drill in a wellbore, the shear pin comprising: a body positionable in the pad stopper of the steering pad; and a head positionable in the lateral pad of the rotary steerable system to deactivate the steering pad by preventing the steering pad from actuating, the shear pin breakable in response to receiving a fluid pulse to enable the steering pad to actuate.

Example 9 is the steering pad of example 8, wherein an outward-facing portion of the shear pin is containable in the pad stopper in response to breaking the body of the shear pin; and wherein an inward-facing portion of the shear pin is containable in the lateral pad in response to breaking the body of the shear pin.

Example 10 is the steering pad of any of examples 8-9, wherein the shear pin includes a notch for separating the outward-facing portion and the inward-facing portion of the shear pin, and wherein the notch includes an intentional deformation of the shear pin for allowing the shear pin to break in response to receiving the fluid pulse.

Example 11 is the steering pad of example 8, wherein the fluid pulse is receivable by the steering pad subsequent to the rotary steerable system exceeding a depth value or a time value associated with a multilateral window of the wellbore.

Example 12 is the steering pad of example 8, wherein the fluid pulse is receivable by the steering pad at a pre-determined pressure for breaking the shear pin.

Example 13 is the steering pad of example 8, further comprising a second shear pin that is: positionable in a second lateral pad for deactivating a second steering pad of the rotary steerable system; and breakable for enabling the second steering pad of the rotary steerable system.

Example 14 is the steering pad of example 8, wherein the shear pin further comprises: a threaded end of the shear pin to couple with a threaded portion of the steering pad; or a male interference fit portion of the shear pin to couple with a female interference fit portion of the steering pad.

Example 15 is a system comprising: a steering pad positionable on a rotary steerable system that is usable for steering a drill in a wellbore; a lateral pad positionable on the rotary steerable system and adjacent to the steering pad; and a shear pin comprising: a body positionable in a pad stopper of the steering pad; and a head positionable in the lateral pad of the rotary steerable system to deactivate the steering pad by preventing the steering pad from actuating, the shear pin breakable in response to receiving a fluid pulse to enable the steering pad to actuate.

Example 16 is the system of example 15, wherein an outward-facing portion of the shear pin is containable in the pad stopper in response to breaking the body of the shear pin, and wherein an inward-facing portion of the shear pin is containable in the lateral pad in response to breaking the body of the shear pin.

Example 17 is the system of any of examples 15-16, wherein the shear pin includes a notch for separating the outward-facing portion and the inward-facing portion of the shear pin, and wherein the notch includes an intentional deformation of the shear pin for allowing the shear pin to break in response to receiving the fluid pulse.

Example 18 is the system of example 15, wherein the fluid pulse is receivable by the steering pad subsequent to the rotary steerable system exceeding a depth value or a time value associated with a multilateral window of the wellbore.

Example 19 is the system of example 15, wherein the fluid pulse is receivable by the steering pad at a pre-determined pressure for breaking the shear pin.

Example 20 is the system of example 15, further comprising a second shear pin that is: positionable in a second lateral pad for deactivating a second steering pad of the rotary steerable system; and breakable for enabling the second steering pad of the rotary steerable system.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method comprising:

positioning a body of a shear pin in a pad stopper of a steering pad of a rotary steerable system that is usable to steer a drill in a wellbore;

positioning the steering pad on the rotary steerable system such that a head of the shear pin is coupled with a lateral pad of the rotary steerable system, wherein the steering pad is coupled to the rotary steerable system through a hinge that allows the steering pad to rotate relative to the rotary steerable system and thereby control steering of the rotary steerable system, and further wherein the shear pin is received by a lateral pad slot;

deactivating, by the head of the shear pin, the steering pad by preventing the steering pad from actuating; and outputting a fluid pulse in the wellbore to break the shear pin for enabling the steering pad to actuate to cause the rotary steerable system to steer the drill in the wellbore.

2. The method of claim 1, further comprising, in response to breaking the body of the shear pin:

containing an outward-facing portion of the shear pin, relative to the steering pad, in the pad stopper; and containing an inward-facing portion of the shear pin, relative to the steering pad, in the lateral pad.

3. The method of claim 2, wherein the shear pin includes a notch for separating the outward-facing portion and the inward-facing portion of the shear pin, and wherein the notch includes an intentional deformation of the shear pin for allowing the shear pin to break in response to receiving the fluid pulse.

4. The method of claim 1, wherein the fluid pulse is output subsequent to the rotary steerable system exceeding a depth value or a time value associated with a multilateral window of the wellbore.

5. The method of claim 1, wherein the fluid pulse is output at a pre-determined pressure for breaking the shear pin.

6. The method of claim 1, further comprising:

positioning a second shear pin in a second lateral pad for deactivating a second steering pad of the rotary steerable system; and in response to breaking the second shear pin, enabling the second steering pad of the rotary steerable system to actuate.

7. The method of claim 1, wherein positioning the body of the shear pin in the pad stopper comprises:

coupling a threaded end of the shear pin with a threaded portion of the steering pad; or coupling a male interference fit portion of the shear pin to a female interference fit portion of the steering pad.

8. A steering pad comprising:

a hinge coupling the steering pad to a rotary steerable system to allow the steering pad to rotate relative to the rotary steerable system and thereby control steering of the rotary steerable system;

a pad stopper that is sized to receive a shear pin that is couplable with a lateral pad of the rotary steerable system usable for steering a drill in a wellbore, the shear pin comprising:

a body positionable in the pad stopper of the steering pad; and a head positionable in a lateral pad slot of the lateral pad of the rotary steerable system to deactivate the steering pad by preventing the steering pad from actuating, the shear pin breakable in response to receiving a fluid pulse to enable the steering pad to actuate.

9. The steering pad of claim 8, wherein an outward-facing portion of the shear pin, relative to the steering pad, is containable in the pad stopper in response to breaking the body of the shear pin; and wherein an inward-facing portion of the shear pin, relative to the steering pad, is containable in the lateral pad in response to breaking the body of the shear pin.

10. The steering pad of claim 9, wherein the shear pin includes a notch for separating the outward-facing portion and the inward-facing portion of the shear pin, and wherein the notch includes an intentional deformation of the shear pin for allowing the shear pin to break in response to receiving the fluid pulse.

11. The steering pad of claim 8, wherein the fluid pulse is receivable by the steering pad subsequent to the rotary steerable system exceeding a depth value or a time value associated with a multilateral window of the wellbore.

12. The steering pad of claim 8, wherein the fluid pulse is receivable by the steering pad at a pre-determined pressure for breaking the shear pin.

13. The steering pad of claim 8, further comprising a second shear pin that is:

positionable in a second lateral pad for deactivating a second steering pad of the rotary steerable system; and breakable for enabling the second steering pad of the rotary steerable system.

14. The steering pad of claim 8, wherein the shear pin further comprises: a threaded end of the shear pin to couple with a threaded portion of the steering pad; or a male interference fit portion of the shear pin to couple with a female interference fit portion of the steering pad.

15. A system comprising:

a steering pad positionable on a rotary steerable system that is usable for steering a drill in a wellbore, wherein the steering pad is coupled to the rotary steerable system through a hinge that allows the steering pad to rotate relative to the rotary steerable system and thereby control steering of the rotary steerable system;

a lateral pad positionable on the rotary steerable system and adjacent to the steering pad; and a shear pin comprising:

a body positionable in a pad stopper of the steering pad; and a head positionable in a lateral pad slot of the lateral pad of the rotary steerable system to deactivate the steering pad by preventing the steering pad from actuating, the shear pin breakable in response to receiving a fluid pulse to enable the steering pad to actuate.

16. The system of claim 15, wherein an outward-facing portion of the shear pin, relative to the steering pad, is containable in the pad stopper in response to breaking the body of the shear pin, and wherein an inward-facing portion of the shear pin, relative to the steering pad, is containable in the lateral pad in response to breaking the body of the shear pin.

17. The system of claim 16, wherein the shear pin includes a notch for separating the outward-facing portion and the inward-facing portion of the shear pin, and wherein the notch includes an intentional deformation of the shear pin for allowing the shear pin to break in response to receiving the fluid pulse.

18. The system of claim 15, wherein the fluid pulse is receivable by the steering pad subsequent to the rotary steerable system exceeding a depth value or a time value associated with a multilateral window of the wellbore.

19. The system of claim 15, wherein the fluid pulse is receivable by the steering pad at a pre-determined pressure for breaking the shear pin.

20. The system of claim 15, further comprising a second shear pin that is:

positionable in a second lateral pad for deactivating a second steering pad of the rotary steerable system; and breakable for enabling the second steering pad of the rotary steerable system.

* * * * *